US006721522B2

(12) United States Patent
Kakeshita

(10) Patent No.: US 6,721,522 B2
(45) Date of Patent: Apr. 13, 2004

(54) PROCESS CARTRIDGE DETACHABLY MOUNTABLE TO A MAIN ASSEMBLY OF AN IMAGE FORMING APPARATUS COMPRISING TRANSFERRING MEANS FOR TRANSFERRING A COLOR DEVELOPER IMAGE ONTO THE IMAGE RECEIVING MATERIAL AND SUCH AN IMAGE FORMING APPARATUS

(75) Inventor: Tomomi Kakeshita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/206,346

(22) Filed: Jul. 29, 2002

(65) Prior Publication Data

US 2003/0147669 A1 Aug. 7, 2003

(30) Foreign Application Priority Data

Jul. 30, 2001 (JP) ..... 2001/230501

(51) Int. Cl.[7] ..... G03G 15/01; G03G 15/08; G03G 15/16

(52) U.S. Cl. ..... 399/150; 399/299

(58) Field of Search ..... 399/149, 150, 399/174, 175, 176, 298, 299; 430/45, 47

(56) References Cited

U.S. PATENT DOCUMENTS 5,698,354 A 12/1997 Ugai et al. ..... 430/45
5,867,755 A * 2/1999 Sato ..... 399/149
5,995,786 A * 11/1999 Ito ..... 399/150
6,013,406 A 1/2000 Moriki et al. ..... 430/110

FOREIGN PATENT DOCUMENTS

JP 6-75484 A * 3/1994

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes a transferring device for transferring, after a first color developer image is transferred onto an image receiving material in a first image forming station, a second color developer image onto the image receiving material in a second image forming station. A second developer carrying member of the second image forming station is capable of collecting a residual developer from a second image bearing member of the second image forming station simultaneously with a developing operation thereto. The moving direction of the second developer carrying member is opposite to a moving direction of the second image bearing member at a development position. A second charging device of the second image forming station includes a second charging member contactable to the second image bearing member, and the second charging member triboelectrically charges the residual developer on the second image bearing member to a regular polarity.

26 Claims, 7 Drawing Sheets

PROCESS CARTRIDGE DETACHABLY MOUNTABLE TO A MAIN ASSEMBLY OF AN IMAGE FORMING APPARATUS COMPRISING TRANSFERRING MEANS FOR TRANSFERRING A COLOR DEVELOPER IMAGE ONTO THE IMAGE RECEIVING MATERIAL AND SUCH AN IMAGE FORMING APPARATUS

FIELD OF THE INVENTION AND RELATED ART

The present invention relates to a color image forming apparatus such as a laser beam printer or an electrophotographic copying machine, and to a process cartridge detachably mountable to a main assembly of the apparatus, and more particularly to a color image forming apparatus of a cleanerless type provided with a plurality of developing devices and a process cartridge therefor. Heretofore, the image forming apparatus such as a copying machine, laser beam printer or the like of an electrophotographic type, an image is formed through a series of image forming process generally including a charging process of electrically charging an image bearing member such as a photosensitive drum to a uniform potential; an exposure process for writing an electrostatic latent image by exposing the charged image bearing member; a developing process of developing the electrostatic latent image into a toner image by depositing the toner to the electrostatic latent image; a fixing process of fixing the toner image on the transfer material; a cleaning process of removing residual matter such an untransferred toner or the like on the surface of the image bearing member after the toner image transfer; and so on.

The untransferred toner collected by the cleaning device in the cleaning process is contained in a container, and are then discarded.

Recently, a cleanerless process has been proposed in which the cleaning device is omitted so that image forming apparatus is downsized, and the necessity for the maintenance operation of discarding the untransferred toner is omitted. One example of such cleanerless process apparatus is such that in a developing device, the residual matter remaining on the non-exposed portion is collected, simultaneously with the toner being deposited on the portion having an exposed and therefore attenuated surface potential portion of the image bearing member through reverse development.

The said residual matter not transferred but remaining on the image bearing member even after the transfer step, is collected into the developing device by the electrostatic force provided by a difference (back contrast) between the surface potential of the image bearing member and t developing bias applied to the developer carrying member, after the residual matter passed through the charging step. This occurs in a cleanerless process in a monochromatic laser beam printer.

More particularly, in the case of a one component developer of a negatively chargeable type, the image bearing member is charged uniformly to −600V in the charging step: in t exposure step, such a portion of the image bearing member as corresponds to t image portion is exposed to light, such that surface potential is attenuated so as to provide −200V of the exposed portion; in the developing process, a DC voltage of −400V is applied to the developer carrying member as a developing bias. By doing so, the residual toner charged to the negative polarity remains on the image bearing member as it is in the exposed portion corresponding to the image portion, but in the non-exposed portion, it is collected back into the developing device by the back contrast. Thus, even without the cleaning device, the untransferred toner can be collected, and it reused as the developer.

In the recent laser bean printer market, the color laser beam printer is becoming dominant.

What is desired is inexpensive and small size color printers, as with the case of the monochromatic printers. Therefore, it is desirable to provide a simple electrophotographic system.

However, when the cleaner-less system used in the prior-art monochromatic electrophotographic system is incorporated in the full-color electrophotographic system, the following problems arise:

FIG. 1 is a schematic sectional view of a conventional image forming apparatus. In the case of the above-described negatively chargeable toner, in the transfer step of transferring the toner onto the transfer material, the positive electric charge is applied to the transfer of detail, and therefore, the toner charged to the negative polarity is transferred onto the transfer material. Therefore, most of the residual toner is normally charged to the positive polarity, but after it passes through the charging step, it is charged to the negative polarity, and therefore, remains on the photosensitive drum.

In this manner, the negative charge toner remaining on the image portion of the photosensitive drum is effective to develop the image portion, whereas the negative charge toner remaining in the non-image portion is collected in a developing device. No problem arises in the monochromatic cleanerless, because the toner remaining in the image portion has the same color.

However, in a color electrophotographic system, a plurality of colors of toner are used, and therefore, there is a possibility of resulting in coloring difference due to the untransferred toner.

FIG. 2 illustrates a behavior of the untransferred toner in an image forming station for a second color in a color electrophotographic system.

In t color electrophotographic system, toner images formed on a photosensitive drum in the respective image forming stations are sequentially transferred and superposed on the same transfer material (paper, OHP sheet or the like) fed by transfer material feeding means in the form of a belt.

With this structure of the image forming apparatus, the toner transferred onto t transfer material in the previous station may be deposited onto the photosensitive drum in the current station when the toner reaches the current station (so called "re-transfer". If this occurs, the toner is mixed into the untransferred toner in the current station (in FIG. 2, the toner of the positive polarity on the is drum after the image transfer.

The untransferred toner of the previous station (re-transferred toner) is of course different in color. These toner particles are passed through the charging device by which toner particles are charged to the negative polarity, and the toner remaining in the non-image portion is collected in the developing device. However, the re-transferred toner having the different color and remaining in the image portion on the photosensitive drum is not collected by the developing zone and remains in the image portion, with the result of ghost image having a different coloring.

In order to avoid the ghost image resulting from the re-transferred toner, the re-transferred toner in the image portion is prevented in the process upstream of the developing process. In a known example, an auxiliary member in the form of a brush for temporarily collecting the untransferred toner on the photosensitive drum upstream of the charging roller. However, this would result in the complicated process and therefore expensive process.

SUMMARY OF THE INVENTION

Accordingly, it is a principal object of the present invention to provide an image forming apparatus and a process cartridge in which color mixture in the developing operation is effectively prevented.

It is another object of the present invention to provide an image forming apparatus and a process cartridge in which re-transferred ghost image is effectively prevented.

It is a further object of the present invention to provide an image forming apparatus and a process cartridge which is suitable to a cleanerless type.

It is a further object of the present invention to provide an image forming apparatus and a process cartridge in which the residual developer on the image bearing member is substantially completely removed during the developing operation.

It is a further object of the present invention to provide an image forming apparatus and a process cartridge in which the polarity of substantially all of the residual developer on the image bearing member is made to be the regular polarity to promote collection during the developing operation.

According to one aspect, the present invention, which achieves at least one of these objectives, relates to an image forming apparatus comprising transferring means for transferring, after a first color developer image is transferred onto an image receiving material in a first image forming station, a second color developer image onto the image receiving material in a second image forming station. The first image forming station includes a first image bearing member, first charging means for electrically charging the first image bearing member, and a first developer carrying member configured and positioned to carry the first color developer to develop an electrostatic image formed on the first image bearing member with the first color developer. The second image forming station includes a second image bearing member, second charging means for electrically charging the second image bearing member, and a second developer carrying member configured and positioned to carry the second color developer to develop an electrostatic image formed on the second image bearing member with the second color developer. The second developer carrying member is capable of collecting a residual developer from the second image bearing member simultaneously with the performing of a developing operation therewith. The second color developer carried on the second developer carrying member is contacted to the second image bearing member. The moving direction of the second developer carrying member is opposite to a moving direction of the second image bearing member at a development position. The second charging means includes a second charging member contactable to the second image bearing member, and the second charging member triboelectrically charges the residual developer on the second image bearing member to a regular polarity.

According to another aspect, the present invention, which achieves at least one of these objectives, relates to a process cartridge detachably mountable to a main assembly of an image forming apparatus. The main assembly comprises transferring means for transferring, after a first color developer image is transferred onto an image receiving material in a first image forming station, a second color developer image onto the image receiving material in a second image forming station. The process cartridge is detachably mountable to the second image forming station. The process cartridge comprises an image bearing member, charging means for electrically charging the image bearing member, and a developer carrying member configured and positioned to carry a second color developer and to develop an electrostatic image formed on the image bearing member with a second color developer. The developer carrying member is capable of collecting a residual developer from the image bearing member simultaneously with the performing of a developing operation therewith. The second color developer carried on the developer carrying member is contacted to the image bearing member. A moving direction of the developer carrying member is opposite to a moving direction of the image bearing member at a development position. The charging means includes a charging member contactable to the image bearing member, and the charging member triboelectrically charges the residual developer on the image bearing member to a regular polarity.

According to still another aspect, the present invention, which achieves at least one of these objectives, relates to an image forming apparatus comprising transferring means for transferring, after a first color developer image is transferred onto an image receiving material in a first image forming station, a second color developer image onto the image receiving material in a second image forming station. The first image forming station includes a first image bearing member, first charging means for electrically charging the first image bearing member, and a first developer carrying member configured and positioned to carry the first color developer to develop an electrostatic image formed on the first image bearing member with the first color developer. The second image forming station includes a second image bearing member, second charging means for electrically charging the second image bearing member, and a second developer carrying member configured and positioned to carry the second color developer to develop an electrostatic image formed on the second image bearing member with the second color developer. The second developer carrying member is capable of collecting a residual developer from the second image bearing member simultaneously with the performing of a developing operation therewith. The second color developer carried on the second developer carrying member is contacted to the second image bearing member.

According to still another aspect, the present invention, which achieves at least one of these objectives, relates to a process cartridge detachably mountable to a main assembly of an image forming apparatus. The main assembly comprises transferring means for transferring, after a first color developer image is transferred onto an image receiving material in a first image forming station, a second color developer image onto the image receiving material in a second image forming station. The process cartridge is detachably mountable to the second image forming station. The process cartridge comprises an image bearing member, charging means for electrically charging the image bearing member, a developer carrying member configured and positioned to carry a second color developer and to develop an electrostatic image formed on the image bearing member with a seconds color developer. The developer carrying member is capable of collecting a residual developer from the image bearing member simultaneously with the performing of a developing operation therewith. The second color developer carried on the developer carrying member is contacted to the image bearing member. A moving direction of developer carrying member is opposite to a moving direction of the image bearing member at a development position.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 FIG. 3 is a sectional view of an image forming apparatus according to a second embodiment.

DESCRIPTION OF THE PREFERRED EMBODIMENT

The description will be made as to the embodiments of the present invention referring to the accompanying drawing, taking an image forming apparatus as an example. The dimensions, materials, configurations, relative positional relations of the constituent elements in the embodiments are not limiting in the present invention unless otherwise stated.

First Embodiment

Figure 3:
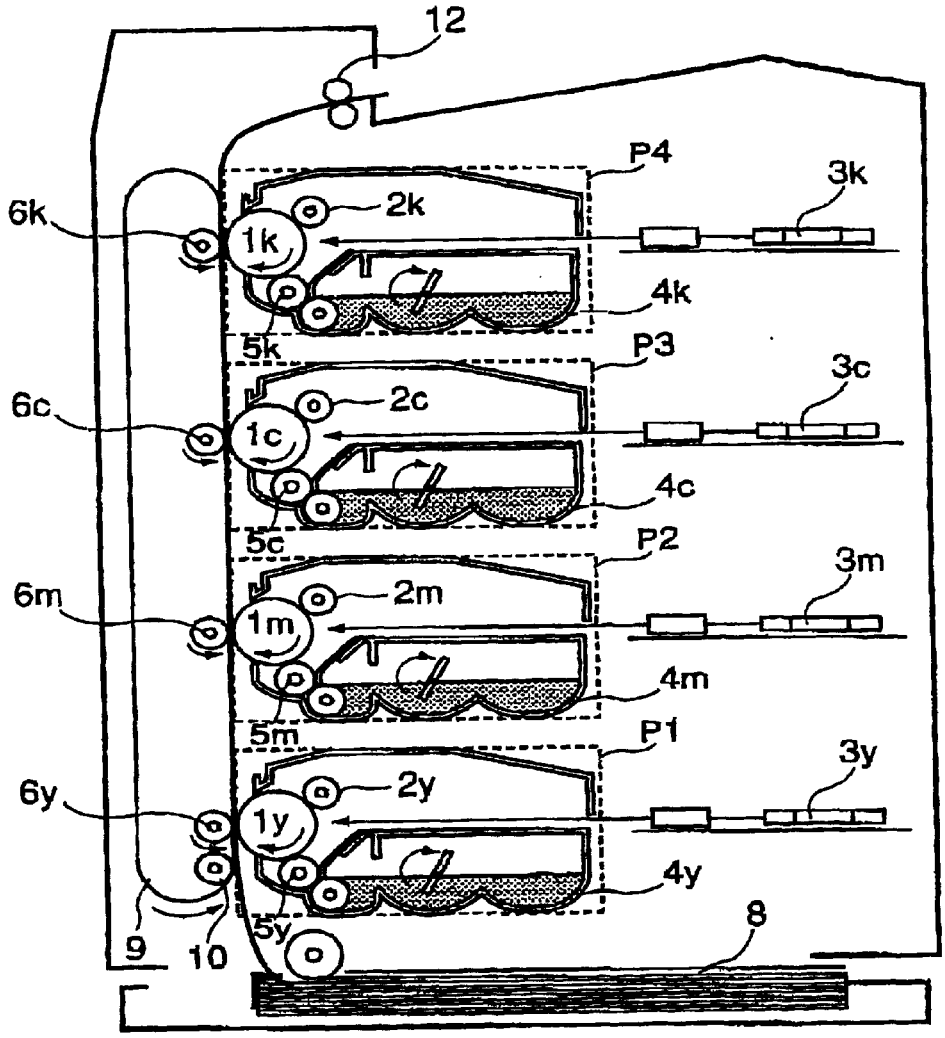
FIG. 3 is a sectional view of an image forming apparatus according to a first embodiment.

FIG. 3 shows a tandem type color laser beam printer having a plurality of developing devices as an example of the image forming apparatus according to the present invention. The Figure is a longitudinal sectional view taken along a feeding direction of the transfer material 8 which is an image receiving material.

As shown in FIG. 3, the color image forming apparatus comprises a transfer belt 9 which is a transfer material feeding means and which travels along an endless path to carry and feed the transfer material 8, and process cartridges P1, P2, P3, P4 which are image forming stations for forming toner images of different colors arranged in a moving direction of the transfer belt 9. These image formation stations have the same basic structures and functions although the colors of the respective toner contained in developing devices 4*y*, 4*m*, 4*c*, 4*k* are different. The process cartridges are detachably mountable to the main assembly of the image forming apparatus.

The image formation unit portions P1 to P4 (image forming means) comprise yellow (Y), magenta (M), cyan (C) and black (Bk) image forming units. The structure of the image formation unit portion comprises photosensitive drums 1*y*, 1*m*, 1*c* and 1*k* (image bearing member), developing devices (developing means) 4*y*, 4*m*, 4*c* and 4*k* containing yellow toner, magenta toner, cyan toner and black toner which are one component developer, respectively and provided with developing rollers 5*y*, 5*m*, 5*c* and 5*k* respectively (developer carrying members for feeding the toner), exposure means 3*y*, 3*m*, 3*c* and 3*k*, charging means (charging member) and charging rollers 2*y*, 2*m*, 2*c* and 2*k*, the developing devices, the exposure means, the charging means being disposed around the associated image bearing members. Transfer rollers 6*y*, 6*m*, 6*c*, 6*k* (transferring means) are disposed opposed to the associated ones of the photosensitive drums 1 with the respective transfer belts 9 therebetween.

The transfer material feeding means in the image forming apparatus are electrostatic transfer belt 9 and are trained around a proper number of rollers to travel around the rollers. On the inside surface of the electrostatic transfer belt 9, there are provided transfer rollers 6 and attraction rollers 10, respectively. The transfer rollers 6 are provided as parts of the respective image formation stations.

The attraction roller 10 for t transfer belt 9 functions to electrostatically attract the transfer material 8 fed from the sheet feeder prior to the image formation onto the electrostatic transfer belt 9. In the image formation stations P1 to P4, the yellow toner image, the magenta toner image, the cyan toner image and the black toner image are sequentially and superposedly transferred onto the transfer material 8 in synchronism with the transfer material 8 electrostatically attracted on the travelling electrostatic transfer belt 9.

The description will be made as to one of the image forming units P1.

The surface photosensitive layer of the photosensitive drum 1*y* driven by unshown driving means is uniformly charged by the charging roller 2*y* supplied with the charging bias −1150V. The charging bias is a DC voltage without an AC voltage component, and is selected to provide −600V of the surface potential of the photosensitive drum 1*y*. More particularly, the photosensitive drum 1*y* is electrically charged to a potential, which is substantially equal to the applied DC voltage minus the discharge starting voltage, by electric discharge phenomenon in the fine gap between the drum 1*y* and the roller 2*y*. In this embodiment, the discharge starting voltage is approx. 550V. The charged surface of the photosensitive drum 1*y* it exposed to image light from the laser scanner indicative of the image formation signal corresponding to the yellow component, so that electrostatic latent image is formed.

When the electrostatic latent image reaches the developing zone with rotation of the photosensitive drum 1*y*, yellow toner of the negative charging polarity is supplied from the developing roller 4*y* to the latent image by the developing bias, so that it is developed into a yellow toner image through reverse development. The yellow toner image is carried to the transfer portion with the rotation of the photosensitive drum 1*y*.

In timed interrelation with the arrival of the yellow toner image at the transfer station, the transfer material 8 electrostatically attracted on the transfer belt 9 is fed, and the yellow toner image is transferred onto the transfer material 8 by the transfer bias (positive) applied to the transfer roller 7*y*. The residual toner not transferred but remaining on the image bearing member 1 is charged to the regular polarity (negative) with which the toner can be collected into the developing device with the aid of the function of the charging roller 2*y*. The photosensitive drum is charged to the negative polarity. Quite a large number of the residual toner particles remaining on the photosensitive drum after the image transfer have the polarity opposite to the regular polarity (negative). However, by the electric charging of the charging roller 2*y* using the discharge, they are charged to the negative polarity. In order to charge the residual toner to the negative polarity with high-intensity, the voltage applied to the charging roller 2*y* is preferably a DC voltage without AC voltage component. Otherwise, that is, if the applied voltage comprises the AC voltage and DC voltage components, the residual toner is electrically discharged by the function of the AC voltage. In order to charge the residual toner on the photosensitive drum to the negative polarity with certainty. the surface layer of the charging roller 2*y* has a triboelectric charge polarity with which the toner is triboelectrically charged to the negative polarity. That is, the material of the surface layer of the charging roller 2*y* and the material of the toner are so selected that toner is triboelectrically charged to the negative polarity by the charging roller. Thereafter, the photosensitive drum is subjected to the light projection in accordance with the image information by the laser scanner with the residual toner remaining on the photosensitive drum. Simultaneously with the developing action of the developing device, the residual toner electrically charged to the regular polarity by the charging roller 2*y* is collected into the developing device. At this time, the photosensitive drum 1*y* is already in the process of the next image forming operation.

The transfer material 8 now carrying the yellow toner image is fed into the image formation station P2 by the traveling of the transfer belt 9. Before the arrival of the transfer material 8 at the transfer material 8, a magenta toner image is formed on the photosensitive drum 1*m* by the laser scanner 3*m* and the developing roller 5*m*, and the toner image is supposedly transferred onto the yellow toner image by the transfer roller 6*m*. The transfer material 8 now having the superposed toner images is further fed into the image formation station P3.

Similarly, in the image formation stations P3, P4, a cyan toner image and a black toner image are formed on the photosensitive drums 1*c*, 1*k* by the laser scanners 3*c*, 3*k* and the developing rollers 5*c*, 5*k*, and are transferred sequentially and supposedly onto the transfer material by the transfer roller 6*c*, 6*k*, so that transfer process is completed.

The transfer material 8 onto which the images have been transferred if fed to the fixing device 12, where it is heated and pressed by which the toner image is fused with color being mixed into a color image, which is fixed on the transfer material 8. Then, the transfer material 8 is discharged to the outside of the apparatus.

The photosensitive drum 1*y* comprises an electroconductive cylindrical drum base member, and a photosensitive layer on the surface thereof (organic photo-semiconductor, amorphous silicon or the like). The photosensitive drum 1 is rotated by driving means (unshown), so that surface thereof is rotated at a predetermined surface moving speed (peripheral speed) in the direction indicated by an arrow.

The charging roller 2*y* comprises a core metal and an elastic member coated with the outer surface, and the surface of the elastic member is contacted to the surface of the photosensitive drum 1*y*.

The developing device 4*y* comprises a rotatable developing roller 5*y*, a developing blade for regulating a layer thickness of the toner carried on the surface of the developing roller 5*y*, and a toner supplying roller 7 (FIG. 4) counterdirectionally rotatable relative to the developing roller to scrape the toner off the developing roller 5*y* while supplying fresh toner to the developing roller 5*y*. The toner supplying roller is press-contacted to the developing roller.

The toner may be magnetic toner or non-magnetic toner, and may be produced through polymerization method or pulverization method. The toner used in this embodiment has a negative chargeable toner which is triboelectrically charged to the negative polarity.

The toner applied on the surface of the developing roller 5*y* with a layer thickness regulated by the developing blade, is deposited onto the exposed portion on the photosensitive drum 1*y* by the application of the developing bias (DC voltage) of −400V applied to the developing roller 5*y* from a voltage source (unshown), by which the electrostatic latent image is developed into a toner image.

On the other hand, the residual matter, such as untransferred toner or the like, which remains on the surface of the photosensitive drum after the toner image transfer, are removed in the following manner.

The toner deposited on the surface of the photosensitive drum from the developing device during the developing operation, is charged to the negative polarity. The toner is electrostatically transferred onto the transfer material by the back side of the transfer material being charged to the positive polarity by the transfer roller 4 during the transfer operation. At this time, the photosensitive drum is also charged to the positive polarity with the result that part of the toner is charged to the positive polarity, and therefore, is not transferred onto the transfer material but remains on the photosensitive drum.

Some of the residual matter remaining on the surface of the photosensitive drum is charged to the positive polarity, and the other is charged to the negative polarity. The negative matter is collected during the development. However, the positive matter is to be charged to the negative polarity in order to permit it to be collected into the developing device by the back contrast. This charging is effected simultaneously with charging of the surface of the photosensitive drum to the negative polarity by the charging roller. By doing so, the residual matter on the photosensitive drum can be collected into the developing device.

Figure 1:
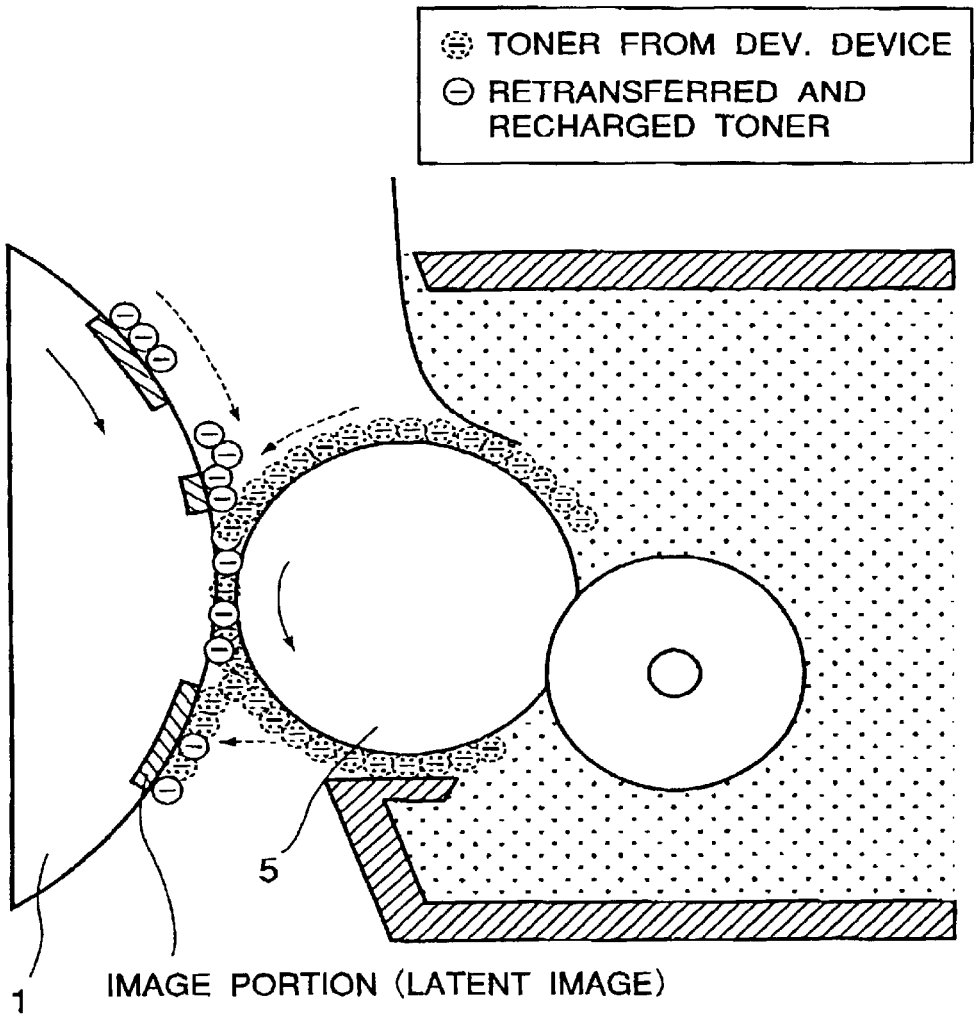
FIG. 1 PRIOR ART
FIG. 1 is a schematic sectional view of a conventional image forming apparatus.
Figure 2:
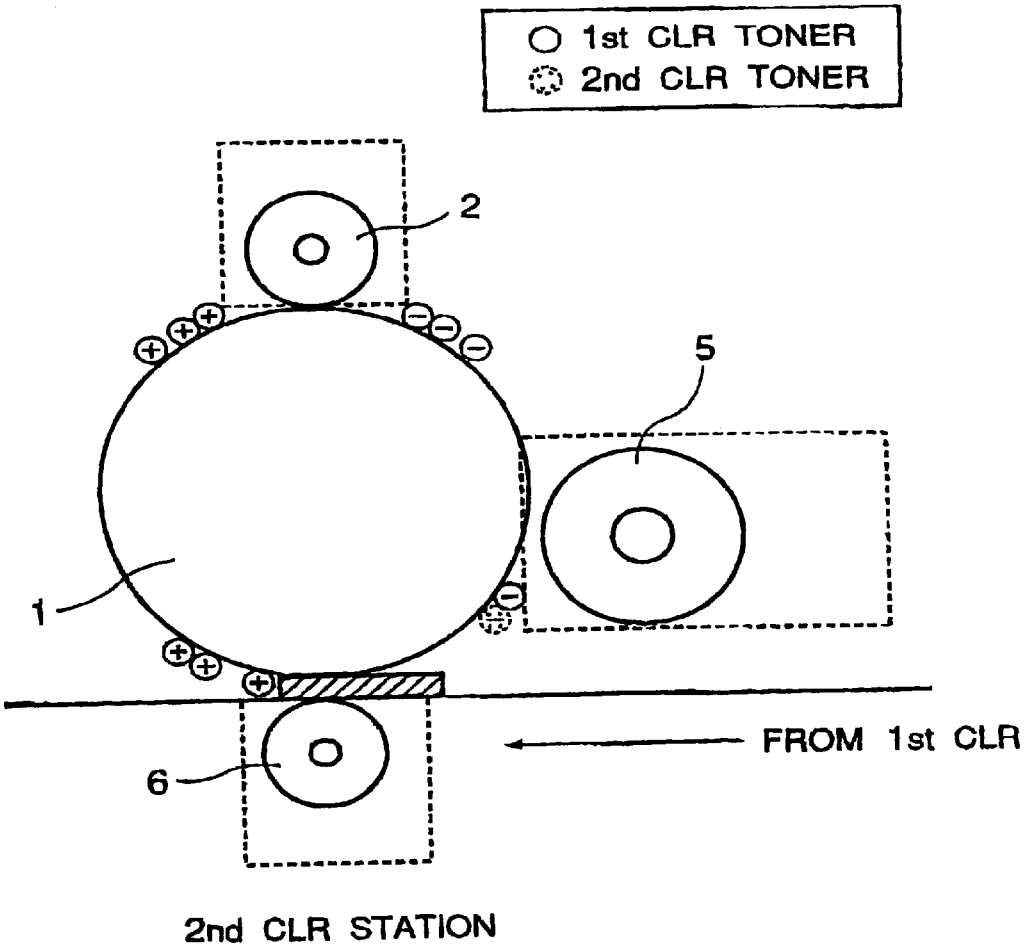
FIG. 2 PRIOR ART
FIG. 2 illustrates behaviour of the untransferred toner in the secondary color station in a color electrophotographic system.

However, in the second color and third color station, when the developing roller rotates relative to t photosensitive drum, the re-transferred toner is not collected into t developing device but remains in the image portion as shown in FIG. 1, with the result of image defect.

In view of this, the simultaneous collection of the re-transferred toner is carried out in the following manner in this embodiment.

Figure 4:
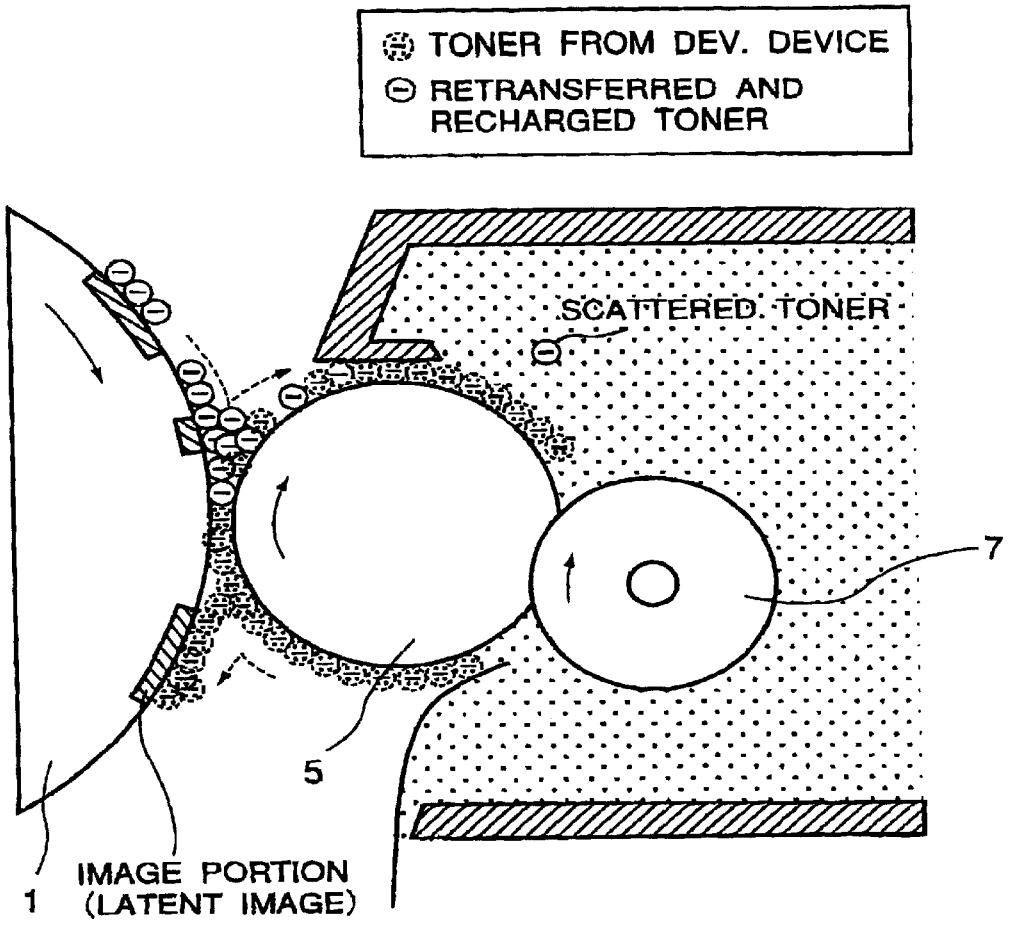
FIG. 4 is a schematic view illustrating collection of the re-transferred toner in the image forming apparatus according to the first embodiment.

As shown in FIG. 4. the developing roller 5 is contacted to the photosensitive drum 1, and is rotated such that peripheral movement of the developing roller 5 in the contact portion is opposite, as indicated by the arrow, the direction of the peripheral movement of the surface of the photosensitive drum 1 which rotates at the predetermined peripheral speed.

In this embodiment, the developing roller is rotated at the peripheral speed which is 170% of the peripheral speed of the photosensitive drum in the opposite peripheral direction. By doing so, as shown in FIG. 4, a peripheral speed difference is provided between the surface of the photosensitive drum 1 and the surface of the developing roller 5, and a nip pressure is produced so that re-transferred toner is mechanically blocked before the nip to stop advancement of the re-transferred toner so as to force the re-transferred toner to be collected into the developing device.

The residual matter collected from the photosensitive drum by the developing roller 5, is stirred in the developing device 4 by the stirring member, and is mixed with the other toner and reused. However, the amount of the re-transferred toner having the different color is very small, and therefore, when it is mixed in the developing device, no problem arises in the developed images.

The assessment has been carried out in the actual images when the developing roller 5 is rotated in the codirectional peripheral movement and when it is rotated in the counterdirectional peripheral movement.

Figure 5:
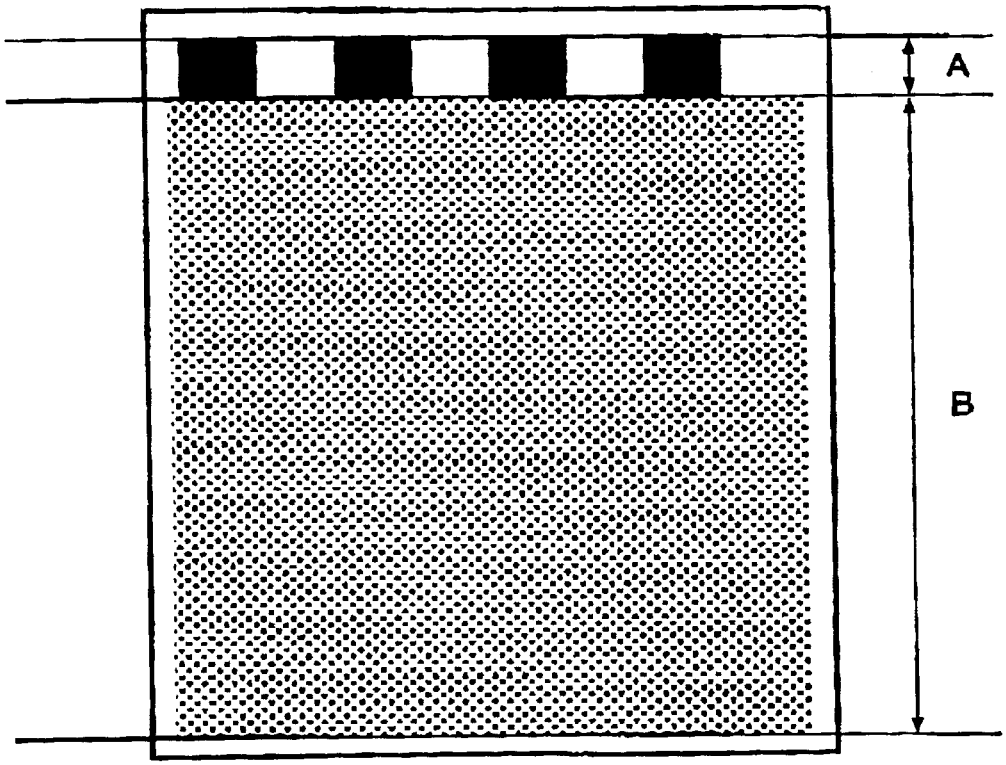
FIG. 5 illustrates a pattern image for confirming the image defect.

The sample image uses is a pattern image as shown in FIG. 5. In A zone, a square solid black image of 4 cm×4 cm is formed, and in B zone, a half-tone pattern is formed. In A, only yellow image formation pattern is formed for the first color, and in B zone, only magenta image formation pattern is formed for the second color.

Figure 6:
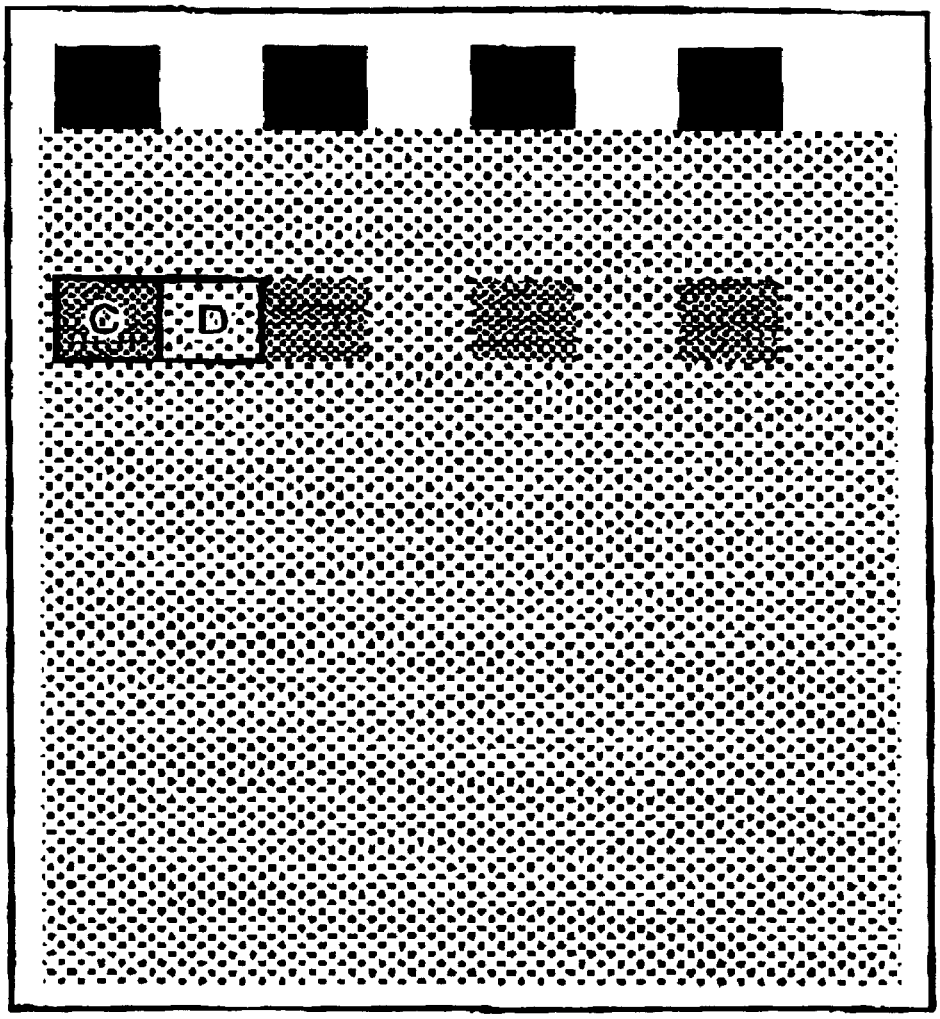
FIG. 6 shows an example of a pattern image involving the re-transferred ghost image.

When the yellow toner is not collected in the developing operation, the image pattern of the A zone appears in the B zone (image defect). The images were produced with the codirectional structure and the counterdirectional structure. When t image defect occurs, the resultant image is as shown in FIG. 6, and the images are compared on the basis of the coloring difference between the C zone and D zone. The results are shown in Table 1.

| | Codirectional | Counterdirectional |
|---|---|---|
| Visual Observation | N | G |

G: no coloring difference is seen
N: coloring difference is seen

Thus, it has been confirmed that coloring is satisfactory in the counterdirectional structure in which the developing roller is rotated in the counterdirectional peripheral movement relative to the photosensitive drum.

In the embodiment as described in the foregoing, the cleanerless type color image formation is such that surface of the developing developing roller is moved in the direction opposite to the direction of the peripheral movement of the surface of the photosensitive drum in the portion where the developing roller is opposed to the photosensitive drum, without use of an auxiliary member such as a brush before the charging station and immediately after the transfer station. This is effective to mechanically block the re-transferred toner before the nip to suppress the advancement of the re-transferred toner, by which the re-transferred toner is enabled to be collected into the developing device. By doing so, high image qualities can be provided without influence of the re-transferred toner in a simple color cleaner-less system.

In this embodiment, a process cartridge is used in which the charging device, the developing device and the photosensitive drum are unified. However, the charging device or the developing device may be provided in the main assembly of the image forming apparatus, and the respective photosensitive drum may be provided in the main assembly of the image forming apparatus.

The image forming apparatus may be in the form of an image system which comprises image inputting means or the like a scanner and control means such as a computer, server or the like.

Second Embodiment

The description will be made as to a second embodiment. In the second embodiment, the structures of the image forming apparatus and the developing device are similar to those of the first embodiment, and therefore, the detailed description thereof is omitted for simplicity, and the charactristical structure of this embodiment only will be described.

In the first embodiment, the use has been made with a charging roller which is driven by the photosensitive drum, for the charging device. In this embodiment, a surface of the charging roller is contacted to the surface of the photosensitive drum which is rotated at the predetermined peripheral speed, and is rotated in the codirectional peripheral moving direction with different peripheral speed or is rotated in the counterdirectional peripheral moving direction.

With such a structure, even if the untransferred toner is deposited on the charging roller, the charging property for the untransferred toner is not deteriorated, so that untransferred toner can be easily charged triboelectrically to the desired polarity for a long term, by which the image defect such as re-transferred ghost image or the like can be effectively avoided. It has been confirmed through the inventors experiments that not less than 1% peripheral speed difference is enough to provide the advantageous effect.

The description will be made as to the structure of the apparatus of this embodiment.

Figure 7:
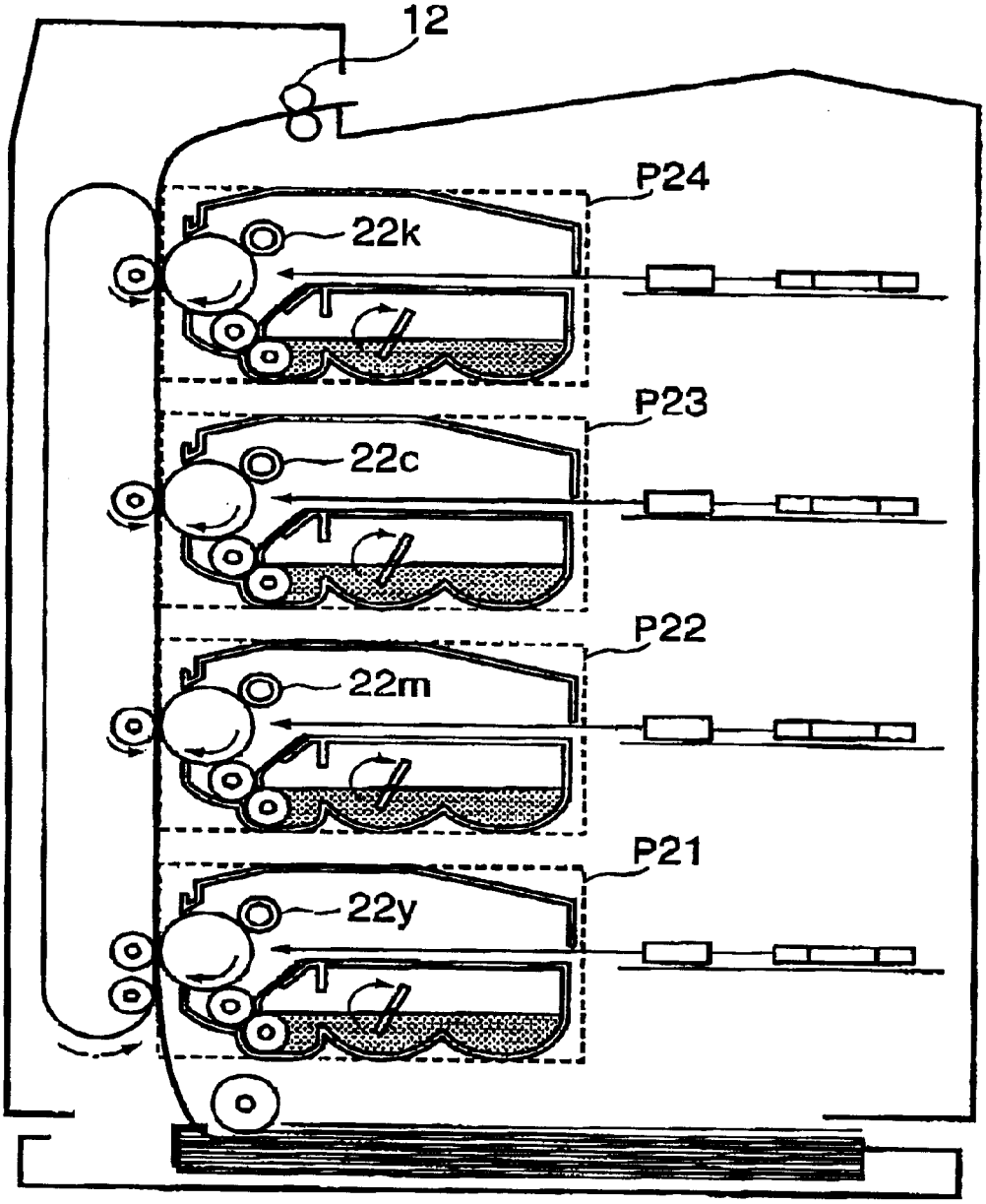

FIG. 7 schematically shows the main assembly of the apparatus. The cartridges P21, P22, P23, P24 comprises as a unit a photosensitive drum, the charging roller, a developing roller and a toner container.

The charging roller 22 is rotated codirectionally relative to the rotational direction of the photosensitive drum at a peripheral speed which is 120% of the peripheral speed of the photosensitive drum. By providing the peripheral speed difference between the surface of the photosensitive drum and the surface of the charging roller, the contamination such as toner on the surface of the charging roller is rubbed, such that contamination is charged to the negative polarity through the triboelectric charging. The toner charged to the negative polarity is moved to the surface of the photosensitive drum to a certain degree by the potential difference between the charging roller and the photosensitive drum (voltage applied to the charging roller 1250V and the photosensitive drum potential −700V, for example). Similarly to Embodiment 1, the charging roller functions to electrically charge the photosensitive drum using electric discharge, and the toner is is charged to the negative polarity also by the electric discharge.

The untransferred toner charged to the negative polarity (including the re-transferred toner) is collected by the developing roller rotating in the opposite peripheral direction relative to the surface of the photosensitive drum, and is fed into the developing container, and the toner is stirred by the stirring member. Since the amount of the re-transferred toner is very small, the mixture thereof into the developing device is not a problem in terms of the resultant image qualities.

The members used in this embodiment are the same as those of the first embodiment. With this structure, the same advantageous effects are provided as with the first embodiment.

By doing so, the contamination of the charging roller due the untransferred toner can be prevented, and high image qualities can be provided without influence of the re-transferred toner in a simple color cleaner-less system.

In the foregoing embodiments, the developing devices in the image forming stations are all the same. However, in view of the fact that re-transferred toner is not easily deposited in the first color image forming station, the same structure of the developing device is not inevitable as long as the developing device in the first color image forming station is concerned. More particularly, the developing roller can be rotated codirectionally relative to the rotational direction of the photosensitive member in the first color image forming station, and the photosensitive member and the developing roller may be out of contact wherein the toner is caused to jump from the developing roller at the photosensitive member in the developing operation, However, in the case that another color toner tends to be fed to the first color image bearing member by the transfer belt, and the re-transferred toner tends to be deposited on the first color image bearing member, the developing device in the first color image forming station may be the same as the developing device of the other station. In the foregoing embodiments, the image receiving material is a transfer material, which is fed to the respective image forming stations on the transfer belt. However, the image receiving member may be an intermediary transfer belt with which the toner images of the respective colors are superposed on the intermediary transfer belt from the image forming stations, and then they are all together transferred from the intermediary transfer belt onto the transfer material.

As described in the foregoing, according to the present invention, the developer carrying member is rotated for the counterdirectional peripheral movement relative to the moving direction of the surface of the image bearing member in a simple color cleaner-less system in which simultaneous development and collection are carried out, so that image defect such as re-transferred ghost image can be prevented.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

transferring means for transferring, after a first color developer image is transferred onto an image receiving material in a first image forming station, a second color developer image onto the image receiving material in a second image forming station;

wherein the first image forming station includes a first image bearing member, first charging means for electrically charging the first image bearing member, and a first developer carrying member configured and positioned to carry the first color developer to develop an electrostatic image formed on the first image bearing member with the first color developer;

wherein the second image forming station includes a second image bearing member, second charging means for electrically charging the second image bearing member, and a second developer carrying member configured and positioned to carry the second color developer to develop an electrostatic image formed on the second image bearing member with the second color developer;

wherein the second developer carrying member is capable of collecting a residual developer from the second image bearing member simultaneously with the performing of a developing operation therewith;

wherein the second color developer carried on the second developer carrying member is contacted to the second image bearing member;

wherein a moving direction of the second developer carrying member is opposite to a moving direction of the second image bearing member at a development position; and wherein the second charging means includes a second charging member contactable to the second image bearing member, the second charging member triboelectrically charges the residual developer on the second image bearing member to a regular polarity, and the second charging member electrically charges the second image bearing member using electric discharge.

2. An apparatus according to claim 1, further comprising feeding means for feeding the image receiving member from the first image forming station to the second image forming station.

3. An apparatus according to claim 1, wherein the second developer carrying member is contacted to the second image bearing member.

4. An apparatus according to claim 3, wherein the second developer carrying member is provided with an elastic layer.

5. An apparatus according to claim 3, wherein the second developer carrying member blocks the residual developer on the second image bearing member before a nip between the second developer carrying member and the second image bearing member to collect the residual developer on the second developer carrying member.

6. An apparatus according to claim 3, wherein the second developer carrying member is supplied with a DC voltage without an AC voltage component.

7. An apparatus according to claim 3, wherein the second color developer is a one-component developer.

8. An apparatus according to claim 1, wherein the second charging member is supplied with a DC voltage without an AC voltage component.

9. An apparatus according to claim 1, wherein the second charging member is rotatable with a peripheral speed difference relative to the second image bearing member.

10. An apparatus according to claim 1, wherein the first developer carrying member is contacted to the first image bearing member and the second developer carrying member is contacted to the second image bearing member.

11. An apparatus according to claim 10, wherein the first and second developer carrying members are provided with an elastic layer.

12. An apparatus according to claim 10, wherein the first developer carrying member blocks the residual developer on the first image bearing member before a nip between the first developer carrying member and the first image bearing member to collect the residual developer on the first developer carrying member, and wherein the second developer carrying member blocks the residual developer on the second image bearing member before a nip between the second developer carrying member and the second image bearing member to collect the residual developer on the second developer carrying member.

13. An apparatus according to claim 10, wherein the first and second charging members are supplied with a DC voltages without an AC voltage component.

14. An apparatus according to claim 10, wherein the first color and second color developers are a one-component developers.

15. An apparatus according to claim 1, wherein the first charging member charges the first image bearing member using electric discharge, and the second charging member charges the second image bearing member using electric discharge.

16. An apparatus according to claim 15, wherein the first and second charging members are supplied with a DC voltage without an AC voltage component.

17. An apparatus according to claim 1, wherein the first charging member is rotatable with a peripheral speed difference relative to the first image bearing member, and the second charging member is rotatable with a peripheral speed difference relative to the second image bearing member.

18. A process cartridge detachably mountable to a main assembly of an image forming apparatus, the main assembly comprising transferring means for transferring, after a first color developer image is transferred onto an image receiving material in a first image forming station, a second color developer image onto the image receiving material in a second image forming station, wherein process cartridge is detachably mountable to the second image forming station, process cartridge comprising:

an image bearing member;

charging means for electrically charging image bearing member; and a developer carrying member configured and positioned to carry a second color developer and to develop an electrostatic image formed on said image bearing member with a second color developer, wherein said developer carrying member is capable of collecting a residual developer from said image bearing member simultaneously with the performing of a developing operation therewith;

wherein the second color developer carried on said developer carrying member is contacted to second image bearing member;

wherein a moving direction of said developer carrying member is opposite to a moving direction of said image bearing member at a development position; and wherein said charging means includes a charging member contactable to said image bearing member, the charging member triboelectrically charges the residual developer on said image bearing member to a regular polarity, and said charging member charges said image bearing member using electric discharge.

19. A process cartridge according to claim 18, wherein the main assembly of the apparatus is provided with feeding means for feeding the image receiving member from the first image forming station to the second image forming station.

20. A process cartridge according to claim 18, wherein said developer carrying member is contacted to said image bearing member.

21. A process cartridge according to claim 20, wherein said developer carrying member is provided with an elastic layer.

22. A process cartridge according to claim 20, wherein said developer carrying member blocks the residual developer on said image bearing member before a nip between said developer carrying member and said image bearing member to collect the residual developer on said developer carrying member.

23. A process cartridge according to claim 20, wherein said developer carrying member is supplied with a DC voltage without an AC voltage component.

24. A process cartridge according to claim 20, wherein the second color developer is a one-component developer.

25. A process cartridge according to claim 18, wherein said charging member is supplied with a DC voltage without an AC voltage component.

26. A process cartridge according to claim 18, wherein said charging member is rotatable with a peripheral speed difference relative to said image bearing member.

* * * * *

UNITED STATES PATENT AND TRADEMARK OFFICE

CERTIFICATE OF CORRECTION

PATENT NO. : 6,721,522 B2
DATED : April 13, 2004
INVENTOR(S) : Tomomi Kakeshita

It is certified that error appears in the above-identified patent and that said Letters Patent is hereby corrected as shown below:

Column 1,
Line 19, “the” should read -- in the --.
Line 31, “an” should read -- as --.
Line 52, “t” should read -- the --.

Column 2,
Line 50, ““re-transfer”.” should read -- “re-transfer”). --.
Line 51, “(in” should read -- in --.

Column 4,
Line 63, “seconds” should read -- second --.

Column 6,
Line 39, “it” should read -- is --.

Column 7,
Line 7, “certainty.” should read -- certainty, --.

Column 8,
Line 42, “FIG. 4.” should read -- FIG. 4, --.

Column 9,
Line 3, “uses” should read -- used --.
Line 32, “developing” (1st occurrence) should be deleted.

Column 10,
Line 36, “is” (2nd occurrence) should be deleted.

Column 12,
Line 40, “voltages” should read -- voltage --.
Line 62, “wherein” should read -- wherein said --.

UNITED STATES PATENT AND TRADEMARK OFFICE

CERTIFICATE OF CORRECTION

PATENT NO. : 6,721,522 B2
DATED : April 13, 2004
INVENTOR(S) : Tomomi Kakeshita

It is certified that error appears in the above-identified patent and that said Letters Patent is hereby corrected as shown below:

Column 13,
Line 10, "second" should read -- said --.

Signed and Sealed this

Twenty-third Day of November, 2004

JON W. DUDAS
*Director of the United States Patent and Trademark Office*